United States Patent [19]

Shirono

[11] Patent Number: 4,930,440

[45] Date of Patent: Jun. 5, 1990

[54] COATER GAP CONTROL ARRANGEMENT

[75] Inventor: Hiroshi Shirono, Habikino, Japan

[73] Assignee: Chugai Ro Co., Ltd., Osaka, Japan

[21] Appl. No.: 383,151

[22] Filed: Jul. 19, 1989

[51] Int. Cl.[5] ..... B05C 1/04

[52] U.S. Cl. ..... 118/663; 118/708; 118/419

[58] Field of Search ..... 118/410, 419, 645, 663, 118/665, 672, 680, 691, 708, 688, 690

[56] References Cited

U.S. PATENT DOCUMENTS

| | | | |
|---|---|---|---|
| 2,558,773 | 7/1951 | Mulloy et al. | 118/419 |
| 3,330,961 | 7/1967 | Juengst et al. | 118/665 |
| 3,900,003 | 8/1975 | Sato et al. | 118/645 |
| 3,995,478 | 12/1976 | Wilhelm | 118/665 |
| 4,704,296 | 11/1987 | Leanna et al. | 118/665 |

*Primary Examiner*—Willard Hoag

*Attorney, Agent, or Firm*—Wenderoth, Lind & Ponack

[57] ABSTRACT

A coater gap control arrangement for controlling the thickness of a film of coating to be formed on a workpiece is provided in a coater, which is equipped with a base, a back-up roll rotatably mounted on one end portion of the base for transporting the workpiece, a coater body slidably mounted on the base and a coater head securely mounted on the coater body for supplying the coating material onto the surface of the workpiece. The coater gap control arrangement is comprised of a position control motor securely mounted on the base for moving the coater body back and forth with respect to the back-up roll to control the position of the coater body, a non-contact type distance meter securely mounted on the coater body for measuring the distance up to the surface of the workpiece, and a processor for controlling the position control motor on the basis of a signal from the distance meter so that a predetermined distance may be kept at all times between the coater head and the workpiece. The coater head and the distance meter confront the back-up roll and are located on opposite sides of a straight line which passes a center of rotation of the back-up roll and along which the coater body can move. Both the coater head and the distance meter form the same angle with respect to this straight line.

5 Claims, 1 Drawing Sheet

COATER GAP CONTROL ARRANGEMENT

BACKGROUND OF THE INVENTION

1. Field of the Invention

The present invention generally relates to a coating machine, and more particularly, to a coater gap control arrangement provided in the coating machine.

2. Description of the Prior Art

A coating machine, hereinafter referred to as a coater, is generally used for coating the surface of a workpiece with coating material such as paint or the like. In the coater, the workpiece is transported by a back-up roll rotatably mounted in the machine. There have been proposed various methods for controlling the gap between the back-up roll and a coater head for supplying the coating material to the surface of the workpiece.

When the workpiece is a web such as a long film, paper or the like, its thickness finely changes in general, resulting in the change of a film of coating.

Conventionally, an operator is required to move the coater head while observing the thickness of the film of coating at all times so that the film of coating may be uniformly formed on the workpiece. Alternatively, the operator is required to measure the thickness of the workpiece in any known method and to move the coater head on the basis of the measured data.

In the former, however, it is very difficult to detect the change of the thickness of the film of coating caused by the fine change of the thickness of the workpiece.

On the other hand, in the latter, it is extremely troublesome to move the coater head in association with the change of the thickness of the workpiece.

SUMMARY OF THE INVENTION

Accordingly, the present invention has been developed with a view to substantially eliminating the above described disadvantages inherent in the prior art methods, and has for its essential object to provide a coater gap control arrangement which enables a coater to uniformly form a film of coating on a workpiece to be coated.

Another important object of the present invention is to provide a coater gap control arrangement of the above described type which is simple in construction and stable in functioning, and can be readily manufactured at a low cost.

In accomplishing these and other objects, a coater gap control arrangement according to the present invention is provided in a coater which is equipped with a base, a back-up roll rotatably mounted on one end portion of the base for transporting a workpiece, a coater body slidably mounted on the base and a coater head securely mounted on the coater body for supplying coating material onto the surface of the workpiece. The coater gap control arrangement is comprised of a position control means securely mounted on the base for moving the coater body back and forth with respect to the back-up roll to control the position of the coater body, a distance measuring means securely mounted on the coater body for measuring the distance up to the surface of the workpiece, and a processor for controlling the position control means on the basis of a signal from the distance measuring means so that a predetermined distance is kept at all times between the coater head and the workpiece. The distance measuring means confronts the back-up roll and forms a predetermined angle with respect to a straight line which passes a center of rotation of the back-up roll and along which the coater body can move. Said predetermined angle is identical with an angle formed between the coater head and the straight line.

BRIEF DESCRIPTION OF THE DRAWINGS

These and other objects and features of the present invention will become more apparent from the following description taken in conjunction with the preferred embodiment thereof with reference to the accompanying drawings, throughout which like parts are designated by like reference numerals, and wherein.

DETAILED DESCRIPTION OF THE PREFERRED EMBODIMENTS

Figure 1:
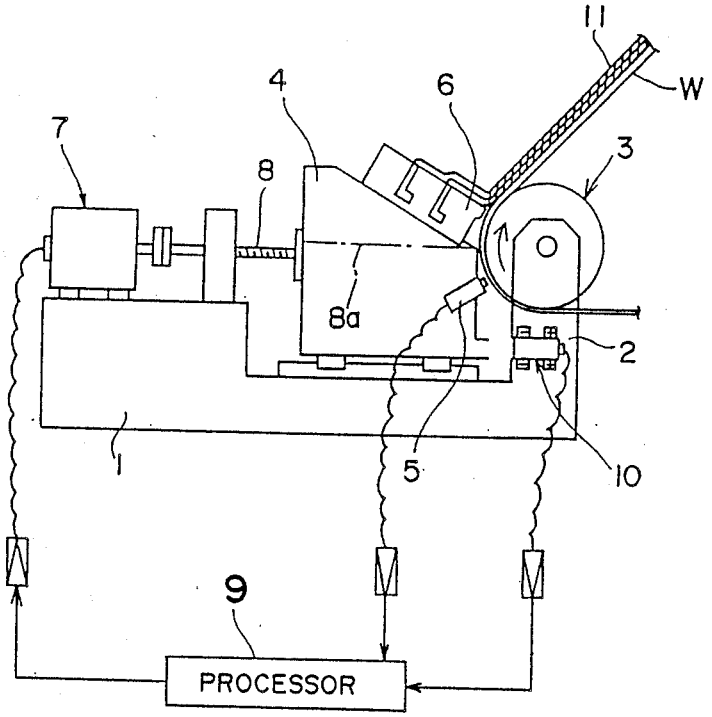
FIG. 1 is a schematic view of a coater provided with a coater gap control arrangement according to the present invention.

Referring now to the drawings, there is shown in FIG. 1 a coater provided with a coater gap control arrangement according to one preferred embodiment of the present invention.

The coater is comprised of a base 1, a back-up roll 3 rotatably mounted on a support portion 2 formed at one end portion of the base 1 for transporting a workpiece W to be coated, a coater body 4 slidably mounted on the base 1, a coater head 6 securely mounted on the coater body 4 for supplying coating material on the surface of the workpiece W, a non-contact type distance meter 5 securely mounted on the coater body 4 for measuring the distance between the coater head 6 and the surface of the workpiece W, and a position control motor 7 securely mounted on the other end portion of the base 1 for controlling the position of the coater body 4. The position control motor 7 moves the coater body 4 back and forth with respect to the back-up roll 3 via a motor shaft 8 and a screw mechanism (not shown).

Figure 2:
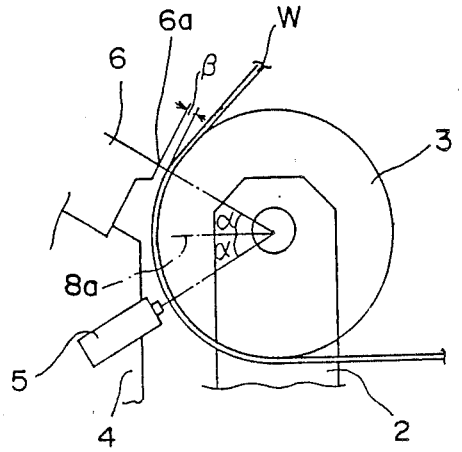
FIG. 2 is an enlarged view of a main portion of FIG. 1.

As shown in FIG. 2, the coater head 6 and the distance meter 5 confront the back-up roll 3 and are respectively located above and below a straight line 8*a*, which passes the center of rotation of the back-up roll 3 in parallel with the motor shaft 8 and along which the coater body 4 can move. An end 6*a* of the coater head 6 and the distance meter 5 form the same angle of a with respect to this straight line 8*a*.

Accordingly, when the position control motor 7 moves the coater body 4 back and forth, both the distance meter 5 and the coater head 6 move back and forth the same distance with respect to the workpiece W.

Reference numeral 9 designates a processor to which a distance signal outputted from the distance meter 5 is inputted for controlling the forward or reverse rotation of the position control motor 7.

A linear gauge sensor 10 is securely mounted on the support portion 2 of the base 1 and measures the distance between the coater body 4 and the support portion 2 i.e., the distance between the back-up roll 3 and the coater head 6. Upon measurement, the linear gauge sensor 10 outputs a signal to the processor 9, which calculates the thickness of the workpiece W on the basis of said signal and the distance signal from the distance meter 5.

In the above described construction, when the surface of the workpiece W is coated with the coating material, the coater body 4 is initially moved so that the distance B between the surface of the workpiece W and the coater head 6, hereinafter referred to as a coater gap, for obtaining the most preferable surface of coating may be found out. In this event, a signal outputted from the distance meter 5 is set as a reference coater gap.

Thereafter, the coater head 6 supplies the coating material onto the surface of the workpiece W to form a film 11 of coating while the workpiece W is being transported by the back-up roll 3.

In this coater, the coater gap B is being measured by the distance meter 5 at all times. Accordingly, if the thickness of the workpiece W changes more than a tolerance limit, the processor 9 immediately drives the position control motor 7 to move the coater body 4 back or forth so that the coater gap B between the coater head 6 and the workpiece W may be rectified to the set value.

When the workpiece W has a joint or joints, it is possible to send a signal indicative of the presence of the joint to the processor 9 to drive the position control motor 7. Accordingly, the coater head 6 would never be damaged by the joint.

The thickness of the workpiece W is calculated by subtracting the distance, obtained by the distance meter 5, between the surface of the workpiece W and the coater head 6 from the distance, obtained by the linear gauge sensor 10, between the back-up roll 3 and the coater head 6.

Furthermore, the oscillation of the back-up roll 3 can be detected by comparing the maximum value with the minimum value of signals outputted from the distance meter 5 during one rotation of the back-up roll 3.

As is clear from the above, according to the coater gap control arrangement of the present invention, the coater head 6 and the distance meter 5 are located on opposite sides of a straight line 8*a* passing the center of rotation of the back-up roll 3 in parallel with the motor shaft 8 and form the same angle with respect to this straight line 8*a*. Accordingly, both the coater head 6 and the distance meter 5 can move the same distance at all times with respect to the back-up roll 3. Furthermore, the processor 9 controls the position control motor 7 on the basis of a signal outputted from the distance meter 5 so that the coater gap B may be kept substantially unchanged.

In such a simplified construction, since the change of the thickness of the workpiece can be greatly reduced, the coating can be successively performed as compared with the conventional coater.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. In a coater for coating a surface of a workpiece with coating material, which is provided with a base, a back-up roll rotatably mounted on one end portion of the base for transporting the workpiece, a coater body slidably mounted on the base and a coater head securely mounted on the coater body for supplying the coating material onto the surface of the workpiece, a coater gap control arrangement comprising:

a position control means securely mounted on the base for moving the coater body back and forth with respect to the back-up roll to control a position of the coater body;

a distance measuring means securely mounted on the coater body for measuring a distance up to the surface of the workpiece, said distance measuring means confronting the back-up roll and forming a predetermined angle with respect to a straight line which passes a center of rotation of the back-up roll and along which the coater body can move, said predetermined angle being identical with an angle formed between the coater head and said straight line; and a processor for controlling said position control means on the basis of a signal from said distance measuring means so that a predetermined distance is kept at all times between the coater head and the workpiece.

2. The arrangement according to claim 1, wherein said coater head and said distance measuring means are disposed on opposite sides of said straight line.

3. The arrangement according to claim 1, wherein said position control means comprises a motor having a motor shaft in parallel with said straight line.

4. The arrangement according to claim 1, wherein said distance measuring means comprises a non-contact type distance meter.

5. The arrangement according to claim 1, further comprising a sensor means securely mounted on one end portion of the base for measuring a distance between the back-up roll and the coater head.

* * * * *